US005400604A

United States Patent [19]

Häfner et al.

[11] Patent Number: 5,400,604

[45] Date of Patent: Mar. 28, 1995

[54] CRYOPUMP AND PROCESS FOR REGENERATING SAID CRYOPUMP

[75] Inventors: Hans-Ulrich Häfner, Köln; Hans-Jürgen Mundinger; Gerd Flick, both of Brühl; Hans-Joachim Forth, Köln; Hans-Hermann Klein, Friedberg; Uwe Timm, Frankfurt, all of Germany

[73] Assignee: Leybold AG, Hanau, Germany

[21] Appl. No.: 64,050

[22] PCT Filed: Sep. 10, 1991

[86] PCT No.: PCT/EP91/01713

§ 371 Date: May 18, 1993

§ 102(e) Date: May 18, 1993

[87] PCT Pub. No.: WO92/08894

PCT Pub. Date: May 29, 1992

[30] Foreign Application Priority Data

Nov. 19, 1990 [EP] European Pat. Off. ..... 90122061

[51] Int. Cl.[6] ..... B01D 8/00

[52] U.S. Cl. ..... 62/55.5; 417/901

[58] Field of Search ..... 62/55.5

[56] References Cited

U.S. PATENT DOCUMENTS

| | | | |
|---|---|---|---|
| 4,697,617 | 10/1987 | Bourke et al. | 137/539 |
| 4,724,677 | 2/1988 | Foster | 62/55.5 |
| 4,958,499 | 9/1990 | Haefner et al. | 62/55.5 |
| 5,062,271 | 11/1991 | Okumura et al. | 62/55.5 |

FOREIGN PATENT DOCUMENTS

| | | |
|---|---|---|
| 119451A1 | 9/1984 | European Pat. Off. . |
| 158295A3 | 10/1985 | European Pat. Off. . |
| 250613A1 | 1/1988 | European Pat. Off. . |
| 394452A1 | 10/1990 | European Pat. Off. . |
| 1937821 | 2/1970 | Germany . |
| 3512614A1 | 10/1986 | Germany . |
| 1170824 | 11/1969 | United Kingdom . |
| WO84/00404 | 2/1984 | WIPO . |
| WO90/02878 | 3/1990 | WIPO . |

OTHER PUBLICATIONS

John Ehmann, "Regeneration of High-Vacuum Cryopumps", 400 Solid State Technology, vol. 25, Apr. 1992, pp. 235–239.

*Primary Examiner*—Ronald C. Capossela

*Attorney, Agent, or Firm*—Spencer, Frank & Schneider

[57] ABSTRACT

The invention relates to a process for regenerating a cryopump (1) that is equipped with an inlet valve (33), with cold surfaces (6, 8, 11) which have a temperature during operation of the pump that effects the condensation and/or adsorption of gases and which are heated for the purpose of regenerating them, the cryopump further including a backing pump (45) that is connected with the pump interior (9) by way of a valve (44). In this process, heating of the cold surfaces begins if the inlet valve (33) is closed and the connection between the pump interior (9) and the connected backing pump (45) is blocked so that, in addition to the temperature of the cold surfaces, the pressure in the pump interior also rises to values that lie above the corresponding values of the triple point of the gas to be removed. The removal of the precipitates released from the cold surfaces is effected in liquid and/or gaseous form through a conduit (46) equipped with a regeneration valve (47) that is actuated as a function of the pressure in the pump interior (9).

43 Claims, 4 Drawing Sheets

CRYOPUMP AND PROCESS FOR REGENERATING SAID CRYOPUMP

BACKGROUND OF THE INVENTION

The invention relates to a process for regenerating a cryopump operated with a refrigeration unit and including an inlet valve, cold surfaces which, during operation of the pump, have a temperature that causes gases to condense and which are heated for the purpose of regenerating them, the cryopump further including a backing pump that is connected with the interior of the pump by way of a valve. The invention also relates to a cryopump suitable for the implementation of this process.

A cryopump operated with a cold source or refrigeration unit is disclosed, for example, in DE-OS [Unexamined Published German Patent Application] 2,620,880. Pumps of this type are usually equipped with three cold surface regions which are intended for the accumulation of different types of gases. The first surface region is in a good thermally conducting contact with the first stage of the refrigeration unit and, depending on the type and power of the refrigeration unit, has an essentially constant temperature between 60 and 100 K. Usually a radiation shield and a baffle are associated with these surface regions. These components protect the lower temperature cold surfaces against incoming thermal radiation. The cold surfaces of the first stage preferably serve for the accumulation of relatively easily condensed gases, such as water vapor and carbon dioxide, by cryocondensation.

The second cold surface region is in thermally conducting contact with the second stage of the refrigeration unit. During operation of the pump, this stage has a temperature of about 20 K. The second surface region serves preferably for the removal of gases that are condensible only at lower temperatures, such as nitrogen, argon or the like, again by cryocondensation.

The third cold surface region also has the temperature of the second stage of the refrigeration unit (correspondingly lower if the refrigeration unit has three stages) and is covered with an adsorption material. These cold surfaces are provided essentially for the cryosorption of light gases, such as hydrogen, helium or the like.

For the regeneration of a cryopump it is necessary to heat the cold surfaces. This can be done by radiation or with the aid of heated regeneration gases that flow through the cryopump housing. Another possibility (see DE-OS 3,512,616) is to equip the cold surfaces with electrical heating devices and to operate the latter during the regeneration process. With the backing pump running and connected to the pump interior, the heating devices heat the cold surfaces, for example, to 70° C. until, after the removal of the precipitated gases, the fore-vacuum pressure (about $10^{-2}$ mbar) is reached again in the pump interior. A total regeneration of the pump operated according to these methods takes many hours, particularly since the regeneration period is composed of the actual regeneration time and the time required to put the pump back into operation, particularly for cooling down the cold surfaces.

Cryopumps are frequently used in the production of semiconductors. In many applications of this type, most of the developing gases charge only the cold surfaces of the second stage. It is therefore known (see, for example, DE-OS 3,512,614) to regenerate only the low temperature cold surfaces. This is done by separately heating the cold surfaces of the second stage.

In all regeneration processes, the inlet valve usually preceding the inlet port of the cryopump must be closed, that is, pump operation and thus production operations must be interrupted.

SUMMARY OF THE INVENTION

It is therefore the object of the present invention to shorten the time required to regenerate a cryopump.

This is accomplished according to the invention by a process of the above-mentioned type in which the following process steps are performed:

- to initiate the regeneration of the cold surfaces to be regenerated with the inlet valve being closed;
- once the connection between the pump interior and the connected backing pump is blocked, heating of the cold surfaces begins so that, in addition to the temperature of the cold surfaces, the pressure in the pump interior also rises;
- heating of the cold surfaces continues until the temperature of the cold surfaces and the pressure in the pump interior has risen to values that lie above the corresponding values of the triple point of the gases to be removed;
- the precipitates released from the cold surfaces are removed in liquid and/or gaseous form through a conduit including a regeneration valve;
- the regeneration valve is actuated as a function of the pressure in the pump interior; the valve is open at a pressure (regeneration pressure) that lies above the pressure of the triple point of the gas to be removed and closes if this pressure is no longer reached;
- after a change in pressure and/or temperature, which is connected with the end of the regeneration, and the thus effected closing of the regeneration valve, the connection of the pump interior with the backing pump is opened and heating of the cold surfaces is discontinued.

The particular advantage of this process is that the removal of the gases which generally are condensed into relatively thick ice layers is effected at a pressure (regeneration pressure) which lies above the pressure of the triple point, thus permitting the use of high evaporation rates without it being necessary to employ an expensive and quantity enlarging regeneration gas. Since, due to the heating, the temperature of the cold surfaces to be regenerated also lies above the temperature of the triple point, the ice changes very quickly into the liquid and/or gaseous phase and can be removed through the regeneration valve. The regeneration of a cryopump—be it the regeneration of the cold surfaces of the second stage or also a total regeneration—can thus be accomplished faster so that the times during which operations must be interrupted are significantly shorter.

In a cryopump operated with a two- or multi-stage refrigeration unit and equipped with cold surfaces which, during operation of the pump, have a temperature that permits the adsorption of light gases and the condensation of further gases, it is advisable, in a modification of the above-described process, to open the connection between the pump interior and the backing pump after the start of the regeneration process until desorption of the light gases has occurred at relatively low pressures. This step requires only a few minutes and avoids high hydrogen concentrations in the pump interior.

The process according to the invention is particularly fast and advantageous if, in a cryopump operated with a two-stage refrigeration unit, only the cold surfaces of the second stage are to be regenerated. This process, in which only the cold surfaces of the second stage are heated, can be performed with the refrigeration unit running. Thus the time required after the regeneration to bring the cold surfaces of the second stage back to their operating temperature is very short, particularly since the regeneration temperature need lie only slightly above the temperature of the triple point of the gas to be removed in order to make it possible at the increased pressure—again above the pressure of the triple point of the gas to be removed—to quickly remove precipitates that change to the liquid and/or gaseous phase.

In order to be able to perform the regeneration of the cryopump within the shortest possible time, it is necessary for the precipitates that change to the liquid and/or gaseous phase to quickly pass through the regeneration valve provided for this purpose. If the regeneration pressure lies below the pressure of the surrounding atmosphere, the conduit connected with the regeneration valve must be equipped with a conveying pump which is able to extract the precipitates through the regeneration valve.

It is particularly advantageous to select the regeneration pressure high enough that it lies above the ambient pressure and to configure the regeneration valve as a check valve. In this solution, a conveying pump associated with the regeneration valve is not required. The regeneration valve opens as soon as the ambient pressure is exceeded in the interior of the pump. Due to the excess pressure in the pump, gaseous precipitates and also those changing to the liquid phase are pushed through the open valve and thus removed quickly. In this solution, the control of the regeneration valve as a function of the pressure in the pump interior is automatic if the ambient pressure is exceeded or not reached, respectively. The use of these measures brings the result that pump down times can be shortened by a factor of 10. It is of course also possible to control a regeneration valve that is not configured as a check valve by way of control means as a function of the pressure in the pump interior or as a function of a change in temperature connected with the completion of the regeneration (for example, in the region of the cold surfaces or of the regeneration valve), particularly if the regeneration pressure is lower than the ambient pressure.

A cryopump suitable for implementing the process according to the invention is characterized by a discharge conduit equipped with the regeneration valve for the precipitates to be removed. Since the removal of the precipitates in their liquid phase is possible particularly quickly, the entrance opening of the discharge conduit in which the regeneration valve is disposed should be located in the lower region of the radiation shield. Still icy precipitates released from the cold surfaces of the second stage also reach this region. It is therefore advisable to provide additional heating means in this region. Funnels or troughs—heated if necessary—to which the discharge conduit is connected may also be provided below the cold surfaces of the second stage.

Advantageously, the regeneration valve is equipped with heating means. After passage of the cold liquids and/or gases, the heating means causes the sealing surfaces which are equipped, for example, with an elastomer sealing ring to be heated so that, after the regeneration, it is ensured that the regeneration valve can be closed in a vacuum tight manner. To avoid excessive heating of the valve, it is advisable to provide a temperature sensor with which the heating energy is regulated. Since heating is no longer necessary after the regeneration is completed and after the valve has been closed and heated to ambient temperature, the information furnished by the temperature sensor can be used to initiate the steps required after the regeneration—switching in the backing pump, delayed turn-off of the heating elements for the cold surfaces, start of operation of the refrigeration unit or the like.

In regeneration tests according to the process of the invention using two-stage cryopumps it was found again and again that, although only the cold surfaces of the second stage were to be regenerated, with the refrigeration unit running, the temperature of the cold surfaces of the first stage also rose to relatively high values. Consequently, the very short time realized by the process according to the invention for the removal of the precipitates was always followed, due to the relatively high thermal stresses on the first stage, by a relatively long time for cooling down the pump. The reason for this thermal stress are gases that evaporate from the second stage and reaching the space between the radiation shield and the outer housing where they establish a thermal bridge. Since the pressure in the interior of the pump is relatively high during the regeneration process, frequently even higher than atmospheric pressure, this thermal bridge is particularly effective. The heat transferred from the outer housing, which is at ambient temperature, to the cold radiation shield thus constitutes a particularly high thermal stress on the first stage.

A suitable modification of a cryopump according to the invention is thus equipped with means which substantially prevent the described heat transfer from the housing to the gases present in the pump and thus to the cold surfaces of the first stage. This thermal insulation may be formed by a material of poor thermal conductivity disposed between the housing and the radiation shield. A particularly effective solution resides in the cryopump being equipped with a vacuum insulation. For this purpose, the walls of the cryopump may be configured in a known manner as double walls. In another expedient solution, the radiation shield itself forms the inner wall of this double wall construction. In these solutions, there no longer is significant heat transfer from the outer pump housing to the cold surfaces of the first stage even at high pressures in the pump interior so that these cold surfaces essentially retain their low temperature. The time required to cool down the cryopump again after the regeneration is significantly shorter.

BRIEF DESCRIPTION OF THE DRAWINGS

Further advantages and details of the invention will be described with references to embodiments thereof that are illustrated in FIGS. 1 to 9, in which.

DETAILED DESCRIPTION OF THE INVENTION

Figure 1:
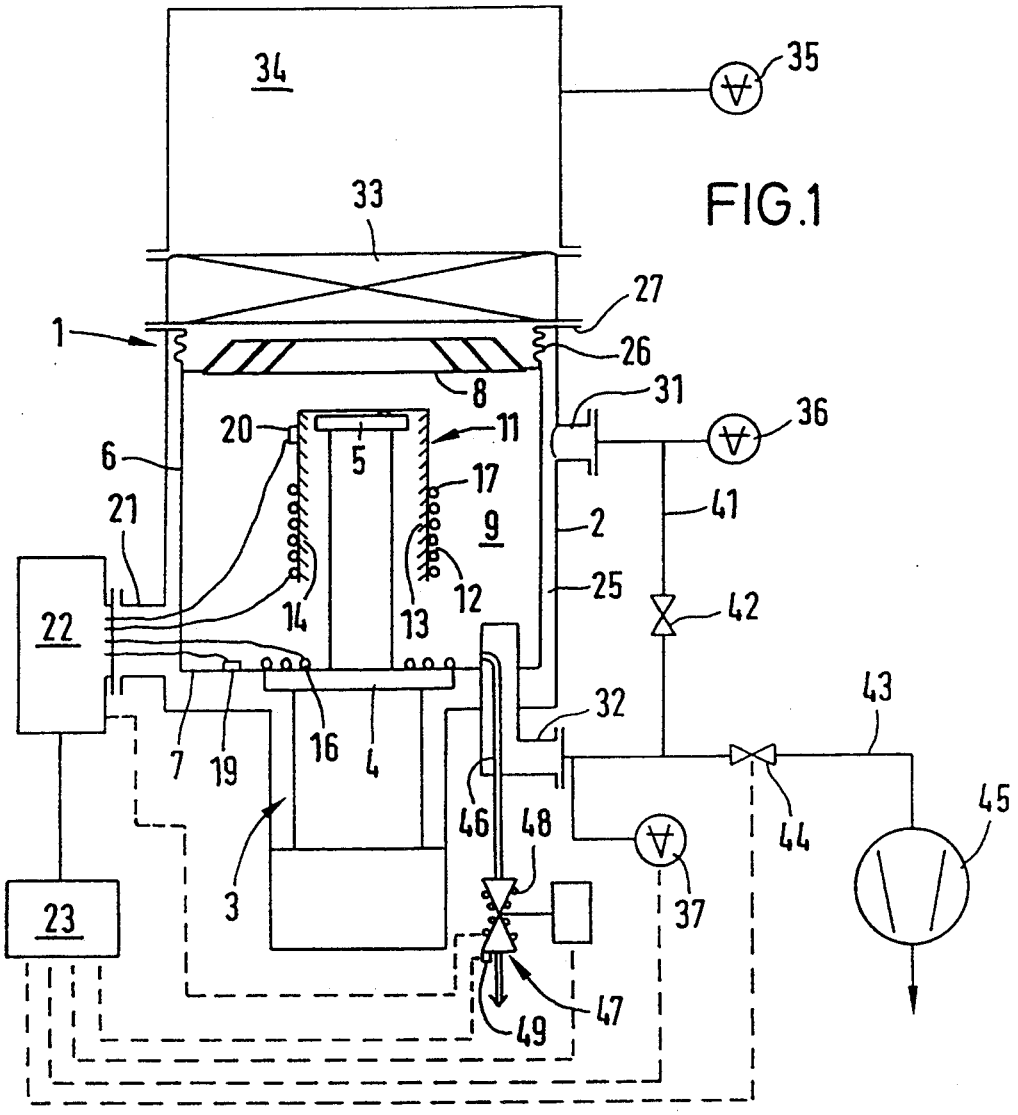
FIG. 1 is a schematic representation of a cryopump according to the invention equipped with control and supply devices.

In all figures, the cryopump is marked 1, its exterior housing is marked 2, the refrigeration unit is marked 3 and its two stages are marked 4 and 5, respectively. The cold surfaces of the first stage 4 include a pot-shaped, upwardly open radiation shield 6 whose bottom 7 is fastened to the first stage 4 in a well thermally conducting and—if necessary—vacuum-tight manner. The cold surfaces of the first stage also include a baffle 8 that is disposed in the entrance region of the cryopump and, together with radiation shield 6, forms the interior 9 of the pump. Baffle 8 is fastened to radiation shield 6 in a manner not shown in detail so as to take on the temperature of radiation shield 6.

Pump interior 9 accommodates the cold surfaces of the second stage, which are generally marked 11 and are formed, for example, by an approximately U-shaped sheet metal section. The U-shaped sheet metal section includes a connecting member which is fastened with good thermal conductivity to the second stage 5 of refrigeration unit 3 so that outer surface regions 12 and inner surface regions 13 result. The outer surface regions 12 form the condensation cold surfaces of the second stage. The inner surface regions 13 are covered with an adsorption material (hatching 14). In this region, light gases are bound by cryosorption.

In order to be able to regenerate cold surfaces 6 to 8 and 11 to 14, which are covered with gases, heating elements are provided. These heating elements are formed by thermal conductors 16 to 18. Thermal conductors 16 for the cold surfaces of first stage 4 are disposed in the region of the bottom 7 of radiation shield 6. Thermal conductors 17 for the cold surfaces of the second stage are attached to the outer cold surface 12. In addition it is also possible to equip the second stage 5 of refrigeration unit 3 with thermal conductors 18 (FIGS. 2, 3, 5 and 7). The current leads for heating elements 16 to 18 and also the leads to temperature sensors 19 and 20 are brought through radiation shield 6 and through a connecting pipe 21 at housing 2 in a vacuum-tight manner that is not shown in detail. A heat supply 22 controlled by a control unit 23 is fastened to connecting pipe 21.

Figure 2:
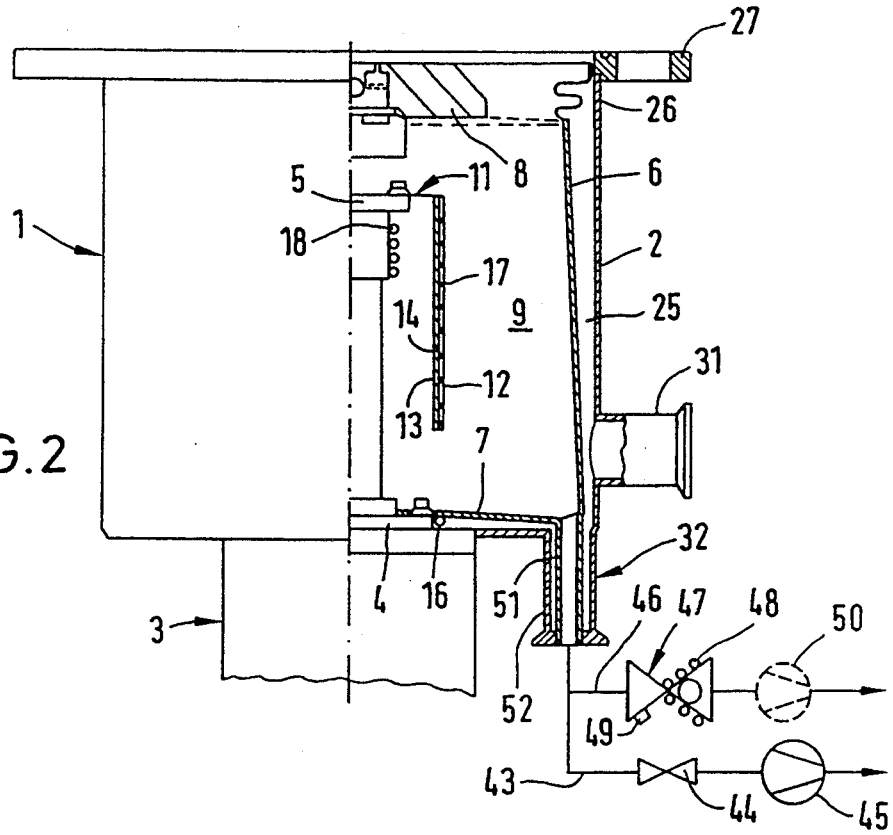
Figure 3:
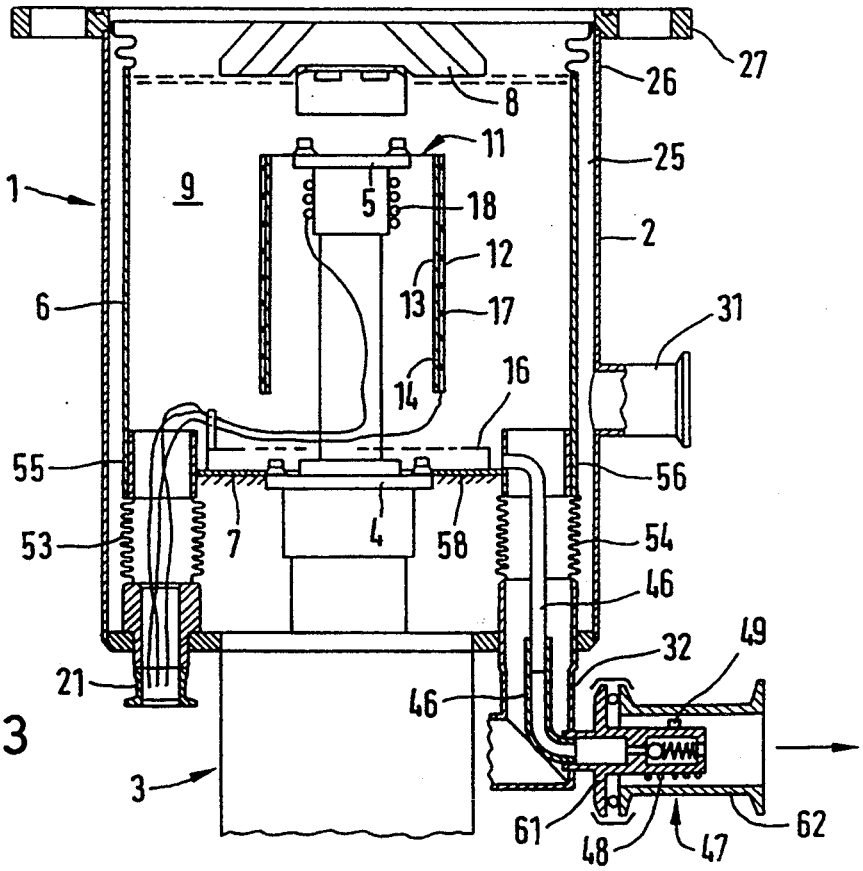

The embodiments according to FIGS. 1 to 3 are equipped with a vacuum insulation which includes radiation shield 6. In order to separate the space 25 between the outer housing 2 and radiation shield 6, which produces the vacuum insulation, from pump interior 9, radiation shield 6 is fastened in a vacuum-tight manner to the first stage of refrigeration unit 3. Moreover, the upper edge of radiation shield 6 is connected, by way of a bellows 26 of a material of poor thermal conductivity (e.g., stainless steel) with outer housing 2. In the illustrated embodiments, outer housing 2 is equipped with a flange 27. Bellows 26 extends between flange 27 and the attachment of radiation shield 6. Its length is selected in such a way that the heat flowing from outer housing 2 or flange 27 through bellows 26 to radiation shield 6 is negligible.

In addition to connecting pipe 21 for the passage of the thermal conductors, the embodiments are equipped with further connecting pipes 31 and 32 which are not shown in some figures. Connecting pipe 31 opens into space 25. Connecting pipe 32 opens into pump interior 9. In the embodiments according to FIGS. 1 to 3, it is brought through space 25 in a vacuum-tight manner.

In the schematically illustrated embodiment of FIG. 1, cryopump 1 is connected to a recipient 34 by way of a valve 33. This inlet valve 33 and recipient 34 are shown only in FIG. 1. In order to observe and measure the pressure in recipient 34, a pressure measuring device 35 is provided. Connecting pipes 31 and 32 are also connected to pressure measuring devices 36 and 37, respectively.

In addition, connecting pipes 31 and 32 are in communication with one another by way of a conduit 41 (FIGS. 1 and 5) which is equipped with a valve 42. Moreover, connecting pipe 32 is connected by way of a conduit 43 equipped with a valve 44 to the inlet of a vacuum pump 45. This pump is a preferably oil-free backing pump, for example a membrane vacuum pump.

In order to operate a pump of the type shown in FIG. 1, the pump interior 9 and space 25 are initially evacuated with the aid of vacuum pump 45, with valve 33 closed and valves 42 and 44 open. Refrigeration unit 3 is put into operation at a pressure of about $10^{-1}$ to $10^{-2}$ mbar, so that the cold surfaces are cooled down. Approximately simultaneously, valve 44 is closed. During the cool-down phase and after the operating temperature has been reached, the cold surfaces of the cryopump bind the gases still present in pump interior 9 and in space 25 (valve 42 is still open), so that a pressure of less than $10^{-5}$ mbar is reached relatively quickly in these chambers. Then valve 42 is closed so that space 25 performs the function of an extremely effective vacuum insulation.

It is advisable to configure valve 42 as a control valve. The control is effected as a function of the pressures in space 25, measured by measuring device 36, and in pump interior 9, measured by measuring device 37. The control is effected, for example, in that valve 42 opens only if the pressure in space 25 rises to about $10^{-3}$ and remains closed during periods in which this pressure is less than $10^{-3}$ mbar so that the space is re-evacuated. Thus it is ensured that pump 1 itself always takes care that the insulating vacuum is maintained in space 25.

During cool-down of the cryopump, a fore-vacuum pressure of about $10^{-1}$ mbar has also been generated in recipient 34 with the aid of a backing pump (e.g. backing pump 45). Once the pump is cooled down and this pressure has been reached in the recipient, valve 33 can be opened and the desired pump operation can begin.

In applications typical for cryopumps, recipient 34 must be evacuated again and again, that is, valve 33 must be closed and reopened in each case. These pump cycles can be repeated until the pump capacity is reached, that is, until the cold surfaces must be regenerated. For this purpose, the cold surfaces to be regenerated are heated and the loosening precipitates are removed through a conduit 46 equipped with a regeneration valve 47. Regeneration valve 47 is equipped with a heating element 48 and with a temperature sensor 49. FIG. 1 shows that heating element 48 is connected with heating energy supply 22. The signal furnished by the temperature sensor is fed to control device 23. In the embodiment according to FIG. 1, valves 44 and 47 are actuated by control device 23. For this purpose, control device 23 also receives the signals furnished by sensors 19 and 20 at both stages 4 and 5 of refrigeration unit 3. Moreover, at least pressure measuring device 37, which indicates the pressure in pump interior 9, is connected with control device 23.

In the embodiments according to FIGS. 2 and 3, valve 47 is configured as a check valve. It opens at a certain pressure in pump interior 9. If regeneration valve 47 leads directly into the environment or into a continuing conduit at ambient pressure, the pressure in pump interior 9 must lie above ambient pressure so that valve 47 will open. If valve 47 is to open already at a pressure below ambient pressure in pump interior 9, then a suitable blower 50 must be disposed in the continuing conduit (shown in dashed lines in FIG. 2).

It is important that no heat from the exterior is able to flow onto radiation shield 6, not even through the walls of connecting pipe 32 which opens into pump interior 9 and must therefore, in the embodiments according to FIGS. 1, 2 and 3, be brought through radiation shield 6 in a vacuum tight manner. A suitable embodiment of the configuration of connecting pipe 32 is shown in FIG. 2. Connecting pipe 32 is formed by two concentric pipe sections 51 and 52. The inner pipe opens into the pump interior and is tightly connected with radiation shield 6, for example by welding. In the exit region, inner pipe 51 is connected in a vacuum-tight manner with outer pipe 52, for example, likewise by welding. Outer pipe 51 opens into space 25 and is connected in a vacuum-tight manner with the outer housing 2. Thus the insulating vacuum of space 25 is also maintained in the annular space between the two pipes 51 and 52. The inner pipe 51 is made of a material having poor thermal conductivity, e.g., stainless steel, and its length has been selected such that the heat transfer from the exterior onto radiation shield 6 is negligible.

To always ensure discharge of the released condensate in different installed positions, bottom 7 and the side walls of radiation shield 6 are inclined with respect to a horizontal or vertical, respectively. The inclination is selected such in each case that the opening of pipe 51 always constitutes the lowest point whether the pump is in the horizontal or the vertical position. Liquids dripping from the cold surfaces of the second stage during the regeneration therefore always reach inner pipe 51 which is followed by discharge conduit 46 and—independently thereof—conduit 43 which leads to backing pump 45.

FIG. 3 depicts an embodiment in which the thermal insulation between radiation shield 6 and outwardly conducted connecting pipes (21, 32) is formed by bellows 53 and 54 of sufficient length. Bellows 53 and 54 are disposed within the pump so that the respective outer sections of connecting pipes 21 and 32 can be kept short.

Toward pump interior 9, bellows 53 and 54 are followed by pipe sections 55 and 56 which partially project into pump interior 9. In this way it is ensured that precipitates changing to the liquid state during the regeneration of the cold surfaces of second stage 5 cannot reach connecting pipes 21 and 32. To enable the liquid gases to be removed quickly, discharge conduit 46 is brought through connecting pipe 32. The latter opens laterally into pipe socket 56, namely directly above bottom 7 of radiation shield 6, and is brought out of connecting pipe 32 outside of cryopump 1. Therefore, liquids formed during the regeneration of the cold surfaces of the second stage and dripping off are able to flow off through conduit 46. Due to the fact that heating element 16 is disposed in the region of the bottom of radiation shield 6, precipitates that come loose while still frozen can be quickly converted to the liquid state.

In the embodiment according to FIG. 3, the underside of bottom 7 of radiation shield 6 is additionally covered with adsorption material 58. This adsorption material is thus disposed within space 25 and contributes to the maintaining of the insulation vacuum. In this solution it is even possible (if space 25 is sufficiently tight) to dispense with the temporary connection of space 25 with pump interior 9. Due to the presence of sorption material on surface regions which are cold when refrigeration unit 3 is running, an insulation vacuum is always ensured in space 25 during operation of the pump. Instead of the adsorption material, getter materials may also be provided.

Figure 4:
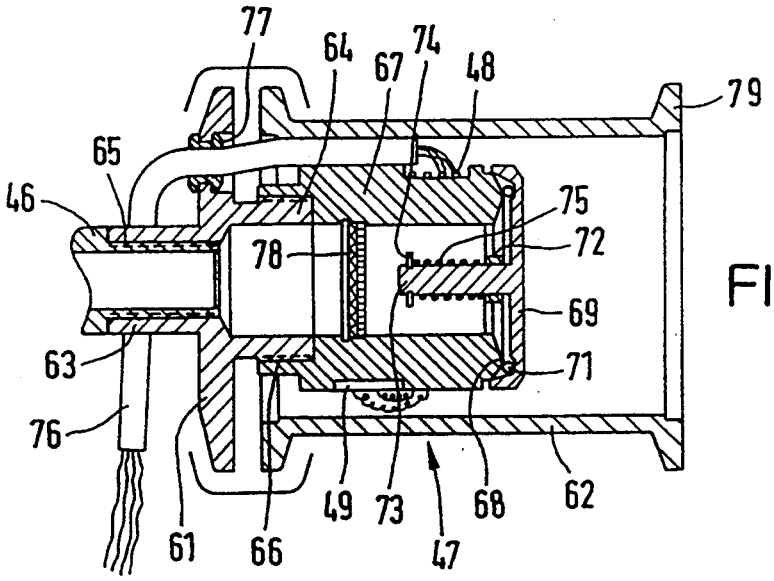
FIGS. 2 to 7 are sectional views of embodiments including a vacuum insulation.

In the embodiments according to FIGS. 3 and 4, discharge conduit 46 opens into a flange 61 which carries regeneration valve 47, configured as a check valve, together with an outer pipe section 62. Flange 61 is equipped on both sides with pipe sockets 63 and 64 (FIG. 4) which are each provided with a thread 65 and 66, respectively. With the aid of thread 65, flange 61 is connected with discharge conduit 46. The essentially cylindrical valve housing 67 is screwed onto thread 66. The free end face of valve body 67 constitutes the valve seat 68 which has an associated valve disc 69 and sealing ring 71. A central sleeve 72 in which a central pin 73 of valve disc 69 is guided is held in the opening at the end face of valve housing 67. Between sleeve 72 and a spring ring 74 on pin 73 there is a compression spring 75 which generates the required closing force. If the pressure in pump interior 9 exceeds the pressure on valve disc 69 and the closing force of spring 75, valve 47 takes on its open position.

The exterior of valve housing 67 is equipped with a heating element 48 and a temperature sensor 49, preferably a PT 100. Supply and signal lines 76 are brought out together through an otherwise sealed opening 77 in flange 61. A filter 78 through which flow the precipitates to be removed is disposed in the interior of the valve housing so as to keep impurities away from valve seat 68. In another embodiment, filter 78 may also be disposed at another location in the discharge line. The outer pipe section 62 is fastened to flange 61 with the aid of a clamp. Further discharge conduits may be connected to its free end face 79.

Figure 5:
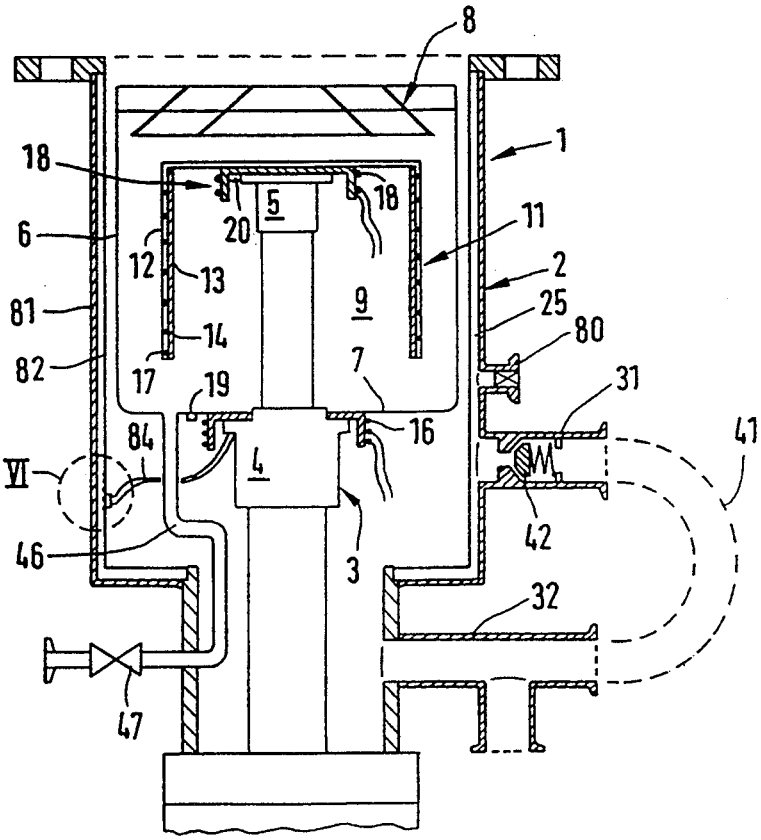
Figure 6:
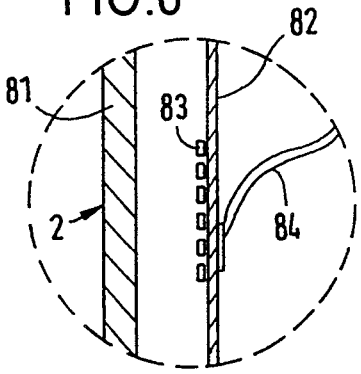
Figure 7:
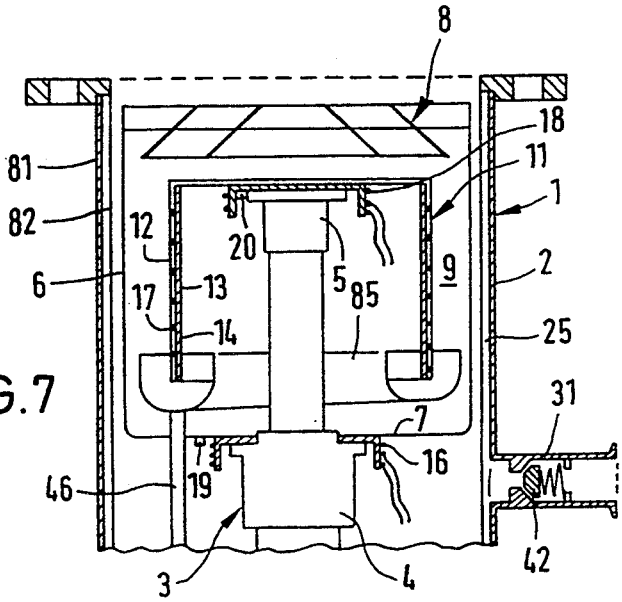

The embodiments according to FIGS. 5 to 7 are equipped with a vacuum insulation 25 which is independent of radiation shield 6. Pump housing 2 has a dual wall configuration. A relatively stable exterior wall 81 is disposed opposite an interior wall 82 that is as thin as possible. A thin interior wall 82, preferably made of stainless steel, has the advantage of a very low thermal conductivity and a low thermal capacity. During the regeneration of the cold surfaces, that is, at a high pressure in pump interior 9, interior wall 82 remains cold so that heat flow from pump housing 2 to radiation shield 6 is negligible. The desired effect can be supported in that interior wall 82 is blackened —at least in part—on its side facing pump interior 9 or is locally thermally connected with radiation shield 6.

If interior wall 82 is very thin (for example, a stainless steel sheet having a thickness of 0.5 mm or less) it must be ensured that the pressure in the insulation vacuum cannot be significantly higher than in pump interior 9 and preferably remains in the mbar range. It is therefore advisable for insulation vacuum 25 to be connectable with pump interior 9 via conduit 41. If the valve 42 in conduit 41 is configured as a controlled or check valve which takes on its open position when the pressure in the insulation vacuum is, for example, about 100 mbar higher than in pump interior 9, thus establishing a connection between insulation vacuum 25 and pump interior 9 if the pressure in pump interior 9 drops to below the pressure of insulation vacuum 25, then too high a pressure of the insulation vacuum, which could lead to a deformation of interior wall 82, is avoided. The evacuation of space 25 is effected through a separate pump pipe socket 80 which is equipped with a locking valve.

In the solution according to FIGS. 5 to 7 it is also of advantage if an adsorption material or a getter material 83 is disposed within insulation vacuum 25 (see FIG. 6). It serves to maintain the insulation vacuum even if there is no connecting conduit 41 with valve 42. The effect of the adsorption material 83 can be augmented by cooling. For this purpose, a cold bridge 84 is provided which is composed of a stranded wire having good thermal conductivity to connect the first stage 4 of refrigeration unit 3 with the region of interior wall 82 where adsorption material 83 is disposed. Another possibility is to blacken the exterior of radiation shield 6—at least partially.

In the embodiment according to FIG. 7, cold surfaces 11 have a rotationally symmetrical shape. A circular trough 85 is disposed below the cold surfaces. The precipitates that come loose, in particular, from cold surface 12 in liquid or ice form enter trough 85 which may be heated so as to accelerate the thawing of the precipitates that are released in the form of ice. The precipitates are removed in the manner described above through discharge conduit 46 which is connected at the lowest point of trough 85.

Figure 8:
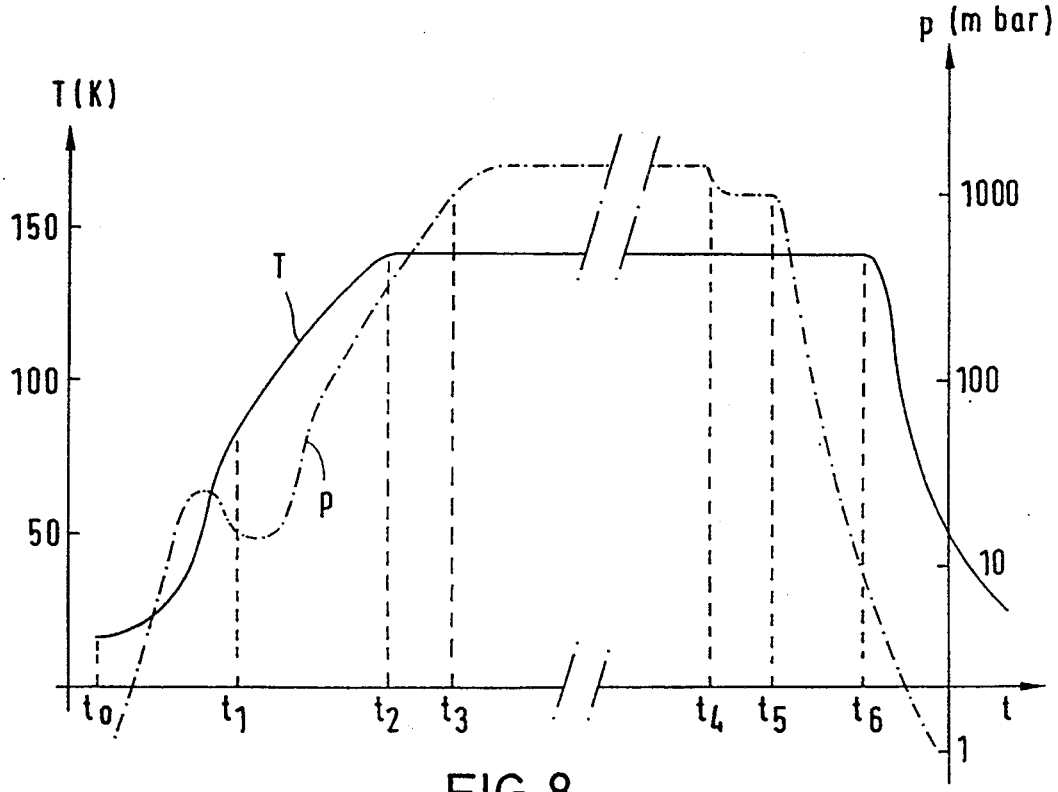
FIG. 8 is a diagram of pressure and temperature curves for an exemplary regeneration process according to the invention.

As already mentioned, in many applications of a cryopump of the described type, the pump capacity of the cold surfaces 11 of the second stage 5 is exhausted substantially earlier than the capacity of the cold surfaces 6 and 8 of the first stage 4 so that it is sufficient to only regenerate the cold surfaces 11 of the second stage. Such a regeneration process will be described with reference to the diagram shown in FIG. 8. The solid line shows the curve of the temperature T at cold surfaces 11, the dash-dot line the curve of the pressure p in pump interior 9.

If it is noted (for example, with the aid of the measuring method disclosed in European Patent 250,613), that the capacity of the cold surfaces of the second stage is exhausted or at least almost exhausted, inlet valve 33 is closed and, at a time $t_0$, heating element 17 and possibly also heating element 18 are turned on. Due to the thus occurring increase in the temperature of cold surfaces 11 the light gases adsorbed in adsorption material 14 are initially released. This results in a pressure increase which decreases again once the light gases are removed by the connected backing pump, namely at a temperature of the cold surfaces 11 of about 80 K. This temperature value or the drop in pressure p in pump interior 9, which indicates the complete removal of the light gases, define a time $t_1$, at which valve 44 (FIGS. 1 and 2) is closed and thus the connection between pump interior 9 and backing pump 45 is severed again. Due to the further rise in temperature T and the thus released precipitates from cold surfaces 12, pressure p rises again. At time $t_2$ temperature T has reached a value that lies above the temperature of the triple point of the gas to be removed, in the present embodiment at 140 K. This temperature lies above the temperature of the triple point of argon. On the one hand, it is sufficient if this temperature is not much higher than the temperature of the triple point of the gas to be removed so as to realize fast cool-down times. On the other hand, this temperature should be selected to be high enough that there will be no adsorption of the gas to be removed on the activated carbon. The temperature of cold surfaces 11 is then held at this value, advisably by turning the heating elements on and off as a function of temperature. After the triple point has been exceeded, the pressure rises very quickly due to boiling and reaches atmospheric pressure (approximately 1,000 mbar) at time $t_3$. Due to the further increase in pressure, valve 47 opens causing the precipitates to be removed to leave the pump in liquid or gaseous form. The gases or vapors passing through valve 47 still have a relatively low temperature which can be determined with the aid of signals furnished by sensor 49.

Once the regeneration is completed (time $t_4$), the pressure in pump interior 9 decreases again. Valve 47 closes. The valve heating element 48 heats the seal locations of the valve so that a reliable closure is ensured. At time $t_5$, this heating process is terminated so that backing pump 45 can be turned on again by the opening of valve 44. This can be done on the basis of the signal furnished by sensor 49. Simultaneously—or with a slight delay at time $t_6$ due to still existing residual vapors—the heating element for cold surfaces 11 can be turned off so that, after a relatively short time, the pressure p and the temperature T drop again to values which are necessary for resumption of pump operations. Advisably, once a starting pressure of about $10^{-2}-1$ mbar is reached, cold surface 11 is cooled again with the aid of backing pump 45.

During the regeneration of the cold surfaces of the second stage, the insulation vacuum in space 25 remains in effect so that no heat transfer occurs from outer housing 2 to radiation shield 6. Refrigeration unit 3 may remain in operation. The heat stress on the first stage during the regeneration of the second stage is therefore substantially less than in prior art cryopumps. The time required for the refrigeration unit to cool the cold surfaces of the second stage down again is significantly shorter than in prior art cryopumps. A significant reduction in the duration of the entire regeneration process is realized.

In a cryopump of conventional size, the described regeneration cycle can be performed in less than one hour. The desorption of the light gases is completed already after about five minutes. To avoid excessive hydrogen concentrations, a dilution with inert gases that are supplied, for example, on the suction side of vacuum pump 45, may be performed. The further heating of the cold surfaces up to a temperature that lies somewhat above the temperature of the triple point of the gas to be removed, can be accomplished in a few minutes. If a gas mixture is present, the cold surfaces must be heated to a temperature that is higher than the highest triple point temperature of the gases present. Since the precipitate is removed not only in gaseous form but also in liquid form, the removal of the precipitates also requires only little time. Since the regeneration cycle can be performed with the refrigeration unit running, the time for cooling down the cold surfaces of the second stage is also very short and cooling can be accomplished in less than 15 minutes. Since the cold surfaces of the first stage retain their relatively low temperatures, the water vapor partial pressure also remains below $10^{-7}$ mbar.

Figure 9:
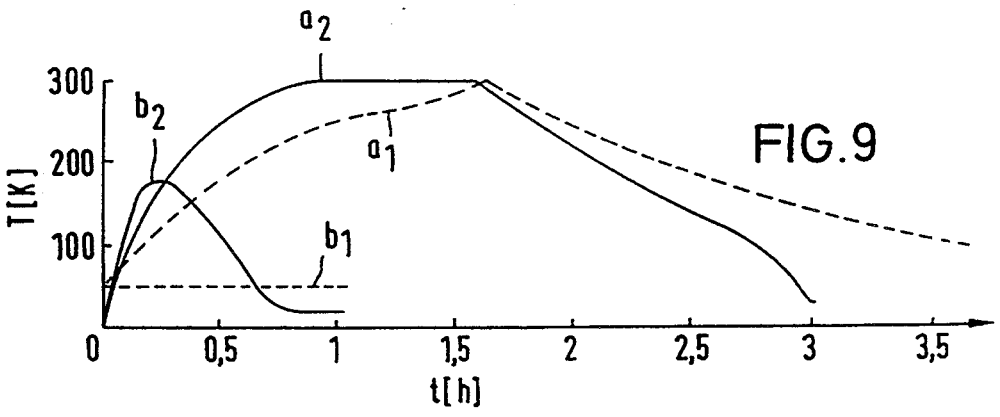
FIG. 9 is a diagram of regeneration times.

The diagram of FIG. 9 will serve to describe the advantages of the invention over the prior art. The curves show the temperature at the pump surfaces of the first stage (dashed curves) and of the second stage (solid curves) during a regeneration process.

Curves $a_1$ and $a_2$ relate to a regeneration process in a pump according to the prior art. The second stage is heated according to curve $a_2$. The temperature of the cold surfaces of the first stage (curve $a_1$) unavoidably rises as well even if their heating system is not turned on. The heating phase takes a relatively long time. After the maximum temperature is reached (in the illustrated diagram after more than 1.5 hours), both stages must be cooled down again which also takes a long time. Prior art regeneration processes therefore require four hours and more depending on the size of the pump.

In a pump according to the invention, the cold surfaces of the second stage can be heated significantly faster and also to specific temperatures (curve $b_2$) since heating of the cold surfaces of the first stage (curve $b_1$) does not occur. Accordingly, the cooling power of the refrigeration unit, after the maximum temperature is reached, is available solely to cool the cold surfaces of the second stage so that the pump is operational again already after less than one hour, with the cold surfaces of the second stage fully regenerated.

To remove condensed gases from the condensation surfaces of the second stage it is sufficient for these cold surfaces to be heated to temperatures that lie clearly below room temperature (for example, 150 K). Due to the regeneration process being specific, it can be shortened further. Advisable in this connection is also a gas type specific control of the temperature of the first stage. This temperature must not be lower than the boiling point of the gases to be removed from the second stage. If, for example, oxygen is to be removed from the cold surfaces of the second stage, part of the condensate changes to the liquid state during the heating phase and drips into radiation shield 6. In this case, the temperature of radiation shield 6 must be higher than 56 K so that the oxygen remains liquid and can, for example, be extracted.

The described process can be applied with standard cryopumps even if they are not equipped with a vacuum insulation 25. The time gained during the regeneration is then a function of the gas type, the gas quantity and the output of the refrigeration unit, etc.

It is claimed:

1. A method of regenerating a cryopump, the cryopump including an inlet valve, a backing pump having a backing pump valve and being connected with an interior of the cryopump, and cold surfaces for condensing gases when the cryopump is operated, the cold surfaces being heatable for regeneration, comprising the steps of:

closing the inlet valve prior to the regeneration of the cold surfaces;

closing the backing pump valve;

heating the cold surfaces so that a temperature of the cold surfaces and a pressure in the cryopump interior rises to a level above a triple point value of the gases so that precipitates are released;

removing the precipitates through a conduit having a regeneration valve until at least one of the temperature and the pressure falls below the triple point, the regeneration valve being open at and above the triple point and being closed when the at least one of the temperature and the pressure is below the triple point, the regeneration valve including a temperature sensor; and opening the backing pump valve and discontinuing the heating step when the regeneration valve is closed.

2. A method as defined in claim 1, wherein said heating step includes maintaining the temperature level near the triple point.

3. A method of regenerating a cryopump using a plural-stage refrigeration unit, the cryopump comprising an inlet valve, a backing pump having a backing pump valve and being connected with an interior of the cryopump, and cold surfaces for the adsorption of light gases and the condensing of remaining gases when the cryopump is operated, the cold surfaces being heatable for regeneration, comprising the steps of:

closing the inlet valve prior to the regeneration of the cold surfaces;

opening the backing pump valve;

heating the cold surfaces until the light gases are desorbed by an adsorption surface comprising activated carbon;

closing the backing pump valve so that a temperature of the cold surfaces and a pressure in the cryopump interior rise to a level above a triple point value of the gases so that precipitates are released, the temperature being selected so as to prevent the adsorption of the condensed gases;

removing the precipitates through a conduit having a regeneration valve until at least one of the temperature and the pressure falls below the triple point, the regeneration valve being open at and above the triple point and being closed when the at least one of the temperature and the pressure is below the triple point; and opening the backing pump valve and discontinuing the heating step when the regeneration valve is closed.

4. A method for regenerating a cryopump using a refrigeration unit, the refrigeration unit comprising first and second stages having respective cold surfaces, the cold surfaces of the first stage being at a higher temperature than the cold surfaces of the second stage, the cold surfaces being for the adsorption of light gases and the condensing of remaining gases when the cryopump is operated and being heatable for regeneration, the cryopump comprising a backing pump having a backing pump valve connected with an interior of the cryopump, and an inlet valve, wherein the cold surfaces of the second stage are regenerated by the steps of:

closing the inlet valve prior to the regeneration of the cold surfaces of the second stage;

opening the backing pump valve;

heating the cold surfaces of the second stage until the light gases are desorbed by an adsorption surface comprising activated carbon;

closing the backing pump valve so that the temperature of the cold surfaces and a pressure in the cryopump interior rise to a level above a triple point value of the gases so that precipitates are released, the temperature being selected so as to prevent the adsorption of the condensed gases;

removing the precipitates through a conduit having a regeneration valve until at least one of the temperature and the pressure falls below the triple point, the regeneration valve being open at and above the triple point value and being closed when the at least one of the temperature and the pressure is below the triple point; and opening the backing pump valve and discontinuing the heating step when the regeneration valve is closed.

5. A method as defined in claim 4, wherein said heating step includes desorbing the light gases using the backing pump, and further wherein said closing the backing pump valve step includes closing the backing pump valve when the cold surfaces of the second stage of said heating step have a temperature of about 80 degrees Kelvin.

6. A method as defined in claim 5, wherein said heating step includes diluting the light gases with an inert gas.

7. A method as defined in claim 4, wherein said heating step includes maintaining the temperature of the cold surface of the first stage at a level above a boiling point of the remaining gases.

8. A method as defined in claim 4, wherein said closing the backing pump valve step includes increasing the pressure in the cryopump interior to a level above ambient atmospheric pressure.

9. A method as defined in claim 4, further including the step of monitoring the second stage temperature in a region of the regeneration valve.

10. A method as defined in claim 9, wherein said monitoring step includes providing the region with a temperature sensor for controlling said opening, removing, heating and closing steps.

11. A regeneratable cryopump, comprising:

a housing having an interior space, said housing including an inlet valve and heatable cold surfaces, a backing pump connected to said interior space;

a refrigeration unit for cooling said cold surfaces;

a discharge conduit including a regeneration valve for the removal of precipitates from said interior space; and a temperature sensor connected to said regeneration valve for sensing the temperature thereof and for generating a signal representing the temperature for actuating said regeneration valve.

12. A cryopump as defined in claim 11, wherein said discharge conduit further comprises a conveying device disposed subsequent to said regeneration valve.

13. A cryopump as defined in claim 11, further comprising a radiation shield disposed intermediate said interior space and said housing, said radiation shield having a base portion, wherein said discharge conduit has an entrance opening being located in said base portion.

14. A cryopump as defined in claim 13, wherein said radiation shield further comprises walls and a base relative to said base portion, said base and said walls being inclined whereby said entrance opening is located at a lowest gravitational point of said radiation shield.

15. A cryopump as defined in claim 13, wherein said base portion includes a heating element.

16. A cryopump as defined in claim 11, wherein said housing includes first and second stages having respective cold surfaces.

17. A cryopump as defined in claim 16, further comprising a funnel having an outlet, said funnel being located below said cold surface of said second stage, said funnel outlet opening into said discharge conduit.

18. A cryopump as defined in claim 17, wherein said funnel is heated.

19. A cryopump as defined in claim 11, wherein said regeneration valve is a check valve.

20. A cryopump as defined in claim 11, wherein said regeneration valve includes a heating element.

21. A cryopump as defined in claim 11, wherein said regeneration valve includes sealing surfaces for closing said regeneration valve in a vacuum tight manner; further comprising a filter preceding said sealing surfaces relative to said interior space for the removal of impurities from the precipitates.

22. A cryopump as defined in claim 61, wherein said regeneration valve includes a pipe section, a valve housing disposed within said pipe section, and a flange, said pipe section and said valve housing being connected to said flange, and further wherein said discharge conduit opens into said flange.

23. A cryopump as defined in claim 11, wherein said regeneration valve includes:

an essentially cylindrical housing having an end opening, said end opening including a concentrically located inner sleeve; and a valve disc having a concentrically located pin corresponding to said sleeve, said pin being guided by said sleeve, said end opening being a valve seat for said valve disc.

24. A cryopump as defined in claim 11, further comprising plural sensors for controlling said regeneration valve.

25. A cryopump as defined in claim 11, further comprising insulating means for reducing a transfer of heat from an exterior of said housing to said cold surfaces.

26. A cryopump as defined in claim 25, wherein said insulating means comprises a radiation shield disposed intermediate said interior space and said housing, and an insulative material disposed intermediate said radiation shield and said housing.

27. A cryopump as defined in claim 25, wherein said housing further comprises a closed, evacuatable space, and first and second walls, said first and second walls forming said closed, evacuatable space therebetween.

28. A cryopump as defined in claim 27, wherein said interior space is a vacuum-tight chamber within said housing, said interior space including coolable surfaces having sorption material applied thereon.

29. A cryopump as defined in claim 28, wherein said housing has an interior wall and an exterior wall forming said closed, evacuatable space therebetween, said interior wall including a first side facing said evacuatable space and having said sorption material applied thereon, said interior wall having a second side facing said interior space; further comprising a cold bridge connecting said second side with a first stage of said refrigeration unit.

30. A cryopump as defined in claim 28, wherein said housing has an interior wall and an exterior wall forming said closed, evacuatable space therebetween, said interior wall being a radiation shield having a side facing said evacuatable space, said side including a bottom region having said sorption material applied thereon.

31. A cryopump as defined in claim 28, wherein said housing has an interior wall and an exterior wall forming said closed, evacuatable space therebetween, said interior wall being a radiation shield and including a partially blackened side facing said evacuatable space.

32. A cryopump as defined in claim 27, wherein one of said walls comprises an interior housing wall of stainless steel.

33. A cryopump as defined in claim 32, wherein said interior housing wall has a thickness of about 0.5 millimeters.

34. A cryopump as defined in claim 25, wherein said refrigeration unit comprises first and second stages having respective cold surfaces; further comprising a radiation shield disposed within said housing, said radiation shield forming said interior space and having said second stage cold surfaces therewithin, said radiation shield being thermally conductivly connected to said first and second stages, and said radiation shield and said housing forming a vacuum-tight space therebetween.

35. A cryopump as defined in claim 34, further comprising an entrance flange including a thermally insulative bellows for compensating for thermal movement, wherein said housing has an opening for establishing a flow path from said interior space to an exterior of said housing, said entrance flange being attached to an upper portion of said radiation shield and covering said opening in a vacuum-tight manner; and wherein said radiation shield is connected with said first stage in a vacuum-tight manner.

36. A cryopump as defined in claim 34, further comprising first and second connecting pipes and a connecting valve, said first and second connecting pipes opening into said vacuum-tight space and said interior space, respectively, and being joined at said connecting valve for fluid communication therebetween.

37. A cryopump as defined in claim 36, wherein said connecting valve comprises a control valve.

38. A cryopump as defined in claim 37, further comprising means for opening said control valve when a pressure within said interior space is in the range of about 0 mbar to about $10^{-3}$ mbar, and for closing said control valve when said pressure is above about $10^{-3}$ mbar.

39. A cryopump as defined in claim 37, further comprising means for opening said control valve when a pressure within said vacuum-tight space is about 100 mbar greater than a pressure within said interior space.

40. A cryopump as defined in claim 34, further comprising concentrically arranged connecting pipes having an annular space formed therebetween, said concentrically arranged connecting pipes protruding through said vacuum-tight space.

41. A cryopump as defined in claim 40, wherein at least one connecting pipe has a thermally insulating bellows comprised of stainless steel and being within said interior space.

42. A cryopump as defined in claim 40, wherein each said connecting pipe has an end projecting through a bottom portion of said radiation shield and into said interior space.

43. A cryopump as defined in claim 40, wherein said concentrically arranged connecting pipes comprise an inner pipe being said discharge conduit.

* * * * *